US008011027B2

(12) United States Patent
Brookman

(10) Patent No.: US 8,011,027 B2
(45) Date of Patent: Sep. 6, 2011

(54) PROTECTIVE SEAL MECHANISM

(75) Inventor: Michael J. Brookman, Branford, CT (US)

(73) Assignee: Interspiro, Inc., Pleasant Prairie, WI (US)

( * ) Notice: Subject to any disclaimer, the term of this patent is extended or adjusted under 35 U.S.C. 154(b) by 1506 days.

(21) Appl. No.: 10/991,782

(22) Filed: Nov. 17, 2004

(65) Prior Publication Data

US 2006/0107448 A1 May 25, 2006

(51) Int. Cl.
*G21F 3/02* (2006.01)
*A41D 13/12* (2006.01)
*A41D 13/00* (2006.01)

(52) U.S. Cl. ..... 2/456; 2/457

(58) Field of Classification Search ..... 2/457, 458, 2/2.11, 2.14, 2.15, 173, 202, 205, 270, 901, 2/DIG. 1, DIG. 3, DIG. 5; 128/201.25, 201.22, 128/201.23, 206.24, 206.28, 201.29
See application file for complete search history.

(56) References Cited

U.S. PATENT DOCUMENTS

| | | | | | |
|---|---|---|---|---|---|
| 458,750 | A * | 9/1891 | Stove | 2/2.15 |
| 1,270,139 | A * | 6/1918 | Fulford | 2/439 |
| 1,289,482 | A * | 12/1918 | Lamb | 2/431 |
| 1,388,959 | A * | 8/1921 | Lamb et al. | 2/428 |
| 1,485,789 | A * | 3/1924 | Logan | 2/428 |
| 1,747,764 | A * | 2/1930 | Engelhard | 2/440 |
| 2,394,078 | A * | 2/1946 | Krupp | 2/2.14 |
| 3,051,963 | A * | 9/1962 | Hallett, Jr. | 285/39 |
| 3,183,917 | A * | 5/1965 | Henneman | 137/81.1 |
| 4,677,976 | A * | 7/1987 | Fujinuma et al. | 128/201.25 |
| 4,901,370 | A | 2/1990 | Suda et al. | |
| 5,119,515 | A | 6/1992 | Altinger et al. | |
| 5,339,806 | A | 8/1994 | Beaussant et al. | |
| 6,328,031 | B1 | 12/2001 | Tischer et al. | |
| 6,748,609 | B1 | 6/2004 | Garigan | |
| 6,792,625 | B2 | 9/2004 | Hexels | |
| 6,854,459 | B1 * | 2/2005 | Cox | 128/201.23 |
| 7,225,470 | B1 * | 6/2007 | Bradford | 2/2.11 |
| 2006/0107448 | A1 * | 5/2006 | Brookman | 2/457 |

OTHER PUBLICATIONS

International Search Report issued in PCT/US2005/041705 mailed on Jul. 6, 2006.
Written Opinion issued in PCT/2005/041705 application mailed on Jul. 6, 2006.

* cited by examiner

*Primary Examiner* — Alissa L Hoey
*Assistant Examiner* — Amber Anderson
(74) *Attorney, Agent, or Firm* — Marshall, Gerstein & Borun LLP

(57) ABSTRACT

A sealing mechanism for use in protective garments, such as hazard suits and the like, enables components of the protective garments, such as gas masks, hoses, respirators and the like to be removably attached to the garment material. The sealing mechanism includes a framing ring which may be attached to an object to be sealed to the garment material and a locking ring. The framing ring and the locking ring are adapted to engage each other in a snap fit type connection while trapping a portion of the garment material therebetween to thereby form an airtight seal between the object and the protective garment.

13 Claims, 6 Drawing Sheets

PROTECTIVE SEAL MECHANISM

GOVERNMENT RIGHTS

This invention was made with U.S. Government support under contract number W91CRB-04-C-0012 awarded by the Technical Support Working Group, TSWG task number 1985, administered by the U.S. Army RDECOM Acquisition Center-W91CBR, 4118 Susqueharma Ave, Aberdeen Proving Ground, MD, 21005-3013. The U.S. Government has certain rights in this invention.

TECHNICAL FIELD

The present invention relates generally to a seal for use in protective garments and, more particularly, to a seal mechanism adapted to bridge the connection between a protective garment and an object removably connected to the protective garment.

BACKGROUND

Protective garments, such as hazard or chemical suits are well known in the art, and are typically worn by a user for protection from a potentially hazardous environment. One type of protective garment is self-contained and wholly encapsulates the user, such that potential leak paths or openings are minimized. For example, a one-piece protective garment may include a zipper or other closing mechanism that allows the user to step into the garment and then close the garment, thereby encapsulating the user. Another such example may be a two-piece protective garment, wherein a lower piece includes a feet and legs portion of the suit, while an upper piece includes a torso, a head, arms, and hands portions of the protective garment. The user may attach the upper and lower portions together via a closing mechanism to thereby, encapsulate the user.

Self-contained or wholly encapsulating garments, however, have some undesirable limitations. For example, a rip or a tear in the garment typically requires that the entire garment, or a large portion of the garment be replaced. Also, if the user is already wearing a gas mask, the user either has to remove the gas mask to wear the protective garment, which may expose the user to a hazardous environment, or the user has to wear the hazard suit over the gas mask, which may be cumbersome and may obstruct the view of the user as the user has to look through both a visor of the gas mask and a viewing window in the protective garment.

There are, however, multi-piece protective garments having a protective material or a suit portion that includes holes, openings, or gaps intentionally made for connecting other portions of the protective garment or objects to the protective garment. For example, a multi-piece protective garment may have boots, gloves, a hood, a mask or other features that may be removably connected to a body portion of the protective garment before use in hazardous conditions. Similarly, protective garments may have features that enable hoses, cables, or other objects to be connected to the protective garment so as to allow these other devices to be used in combination with the protective garment. These multi-piece type garments, however, require a strong and continuous seal between the garment and the objects attached to the garment. Still further, to be of maximum utility, the sealing mechanism used in these multi-piece garments should be easy to manipulate while the user is wearing the protective garment.

Some seals and sealing mechanisms that connect protective garment components together are known in the art. For example, U.S. Pat. No. 6,748,609 discloses a garment having a protective over-garment, gloves, and over-boots and a sealing mechanism that produces an air tight barrier between the gloves and the over-garment or between the over-boots and the over-garment. In this garment arrangement, each connection point or interface between the gloves, the over-boots and the over-garment includes an annular drawstring interface and a dilating elastomeric sheath. An airtight seal between the various components is made by first drawing-up and tightening one of the components, such as the over-garment, onto or over a portion of another component, such as the gloves. The elastomeric sheath is then extended or stretched over the connection between the over-garment and gloves, for example, to thereby constrict the elastomeric sheath over the interface, which causes the elastomeric sheath to compressively engage the interface and the user's body and create an air-tight barrier at the interface.

While known seals and sealing mechanisms typically work well for their intended purpose, these and other sealing Mechanisms have limitations and problems that make their adaptation for certain uses difficult, if not impossible. For example, some of the seals or sealing mechanisms lack a positive locking mechanism that provides the user with the knowledge that a proper seal has been made. This positive locking feature is important in particularly hazardous environments and in environments in which the user may not be able to detect a leak in the garment during use. Similarly, some of the known seals or sealing mechanisms are unable to create the necessary quality of seal required for certain hazardous or potentially hazardous environments. Still further, some known sealing mechanisms, such as the sealing mechanism of U.S. Pat. No. 6,748,609, require the user to perform multiple and different sealing steps, which makes it more likely that an airtight seal will not be obtained during assembly of the garment. Additionally, such seals may be compromised during use by movements of the wearer, resulting in slow leaks during use of the garment.

SUMMARY OF THE DISCLOSURE

A protective garment, such as a hazard suit, includes a main body portion that is constructed from at least one pliable or flexible sheet of material and which includes openings or apertures designed to allow objects such as a visor or a respirator of a gas mask, gloves, boots, hoses, and the like to be attached to the material. A removable seal or sealing mechanism that is easy to operate connects or attaches one or more of the objects to the sheet of material in an airtight manner. In one embodiment, the seal or sealing mechanism includes a framing ring and a locking ring that operate together to form the seal between the material and one of the objects. The framing ring includes a first channel that operatively engages a ridge on the object to be attached to the suit, thereby securing the framing ring to the object in an airtight manner. The framing ring additionally includes a second channel that receives an edge of the sheet of material and the locking ring includes a wall member that fits snugly into the second channel of the framing ring. During use, the wall member on the locking ring is snap fit or otherwise disposed in the second channel of the framing ring along with the edge of the sheet of material to secure the edge of the sheet of material between the framing ring and the locking ring and thereby produce an airtight seal between the material and the object.

Figure 1:
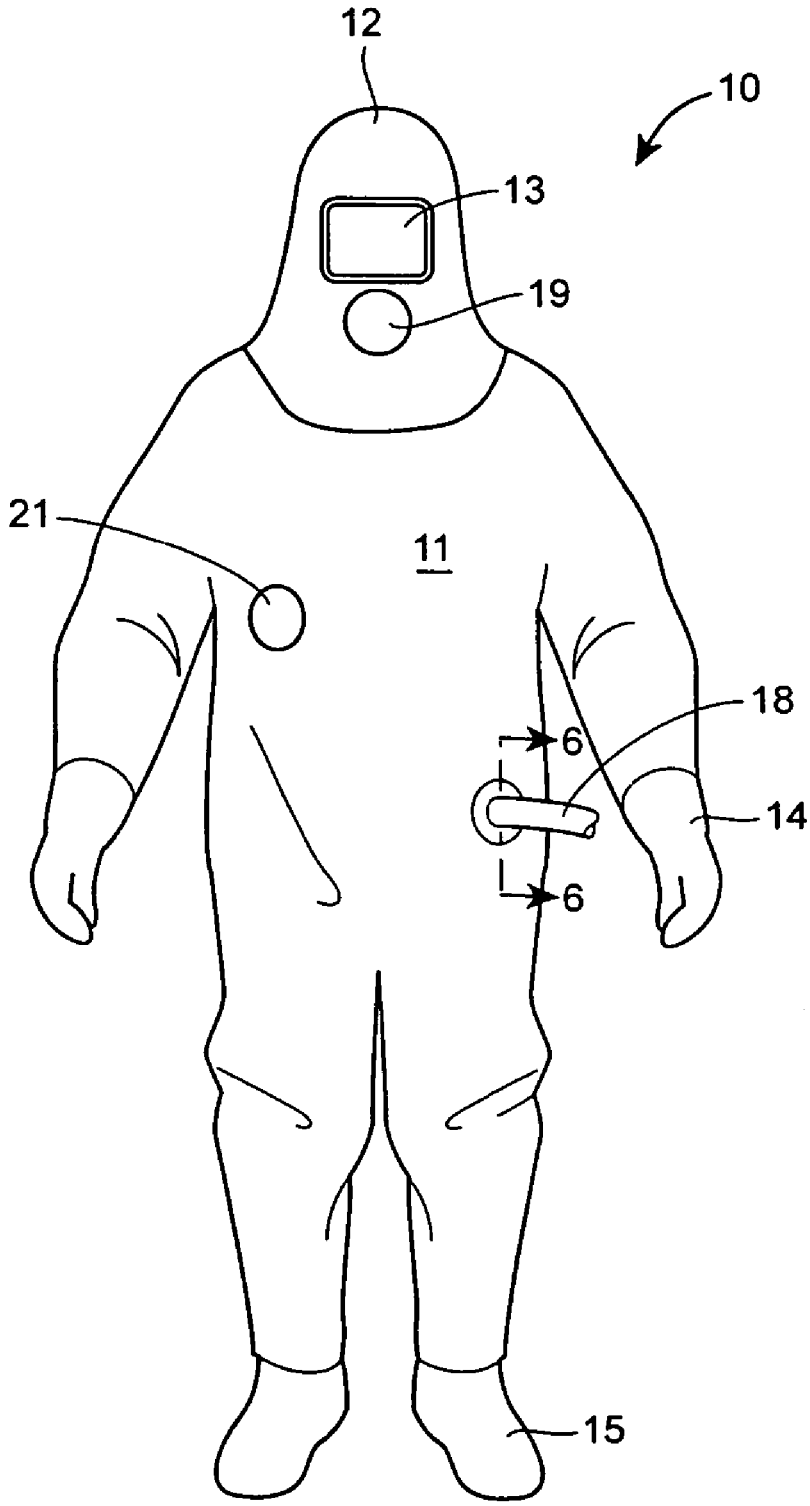
FIG. 1 is an isometric view of a person in a hazard suit which includes protective seals that removably connect or attach a body portion of the hazard suit to other portions or objects associated with the hazard suit.

While the methods and devices described herein are susceptible to various modifications and alternative constructions, certain illustrative embodiments thereof have been shown in the drawings and will be described below in detail. It should be understood, however, that there is no intention to limit the invention to the specific forms disclosed. To the contrary, the intention is to cover all modifications, alternative constructions, and equivalents falling within the spirit and scope of the invention as defined by the appended claims.

DETAILED DESCRIPTION

FIG. 1 illustrates a protective garment in the form of a hazard suit 10, having a main body portion 11 connected to a hood 12, gloves 14, and boots 15. Additionally, a gas mask 13 and a respirator 19 are removably connected to the hood 12 while a hose or an air supply connection 18 is removably connected to the main body portion 11 of the hazard suit 10. A ventilator 21 is also illustrated as being connected to the hazard suit 10 and the ventilator 21 may be either removably or fixedly attached to the hazard suit 10. As is generally known, the hazard suit 10, the hood 12, the gloves 14, and the boots 15 may be constructed from, or may include a flexible non-permeable sheet of material that protects a wearer or a user from a hazardous environment, with the type or nature of the material differing depending on the type of hazardous environment in which the suit 10 is intended to be used. As examples only, the protective garment 10 may be constructed of plastic, rubber, any of a number of known polymer materials or any other suitable material.

Figure 2:
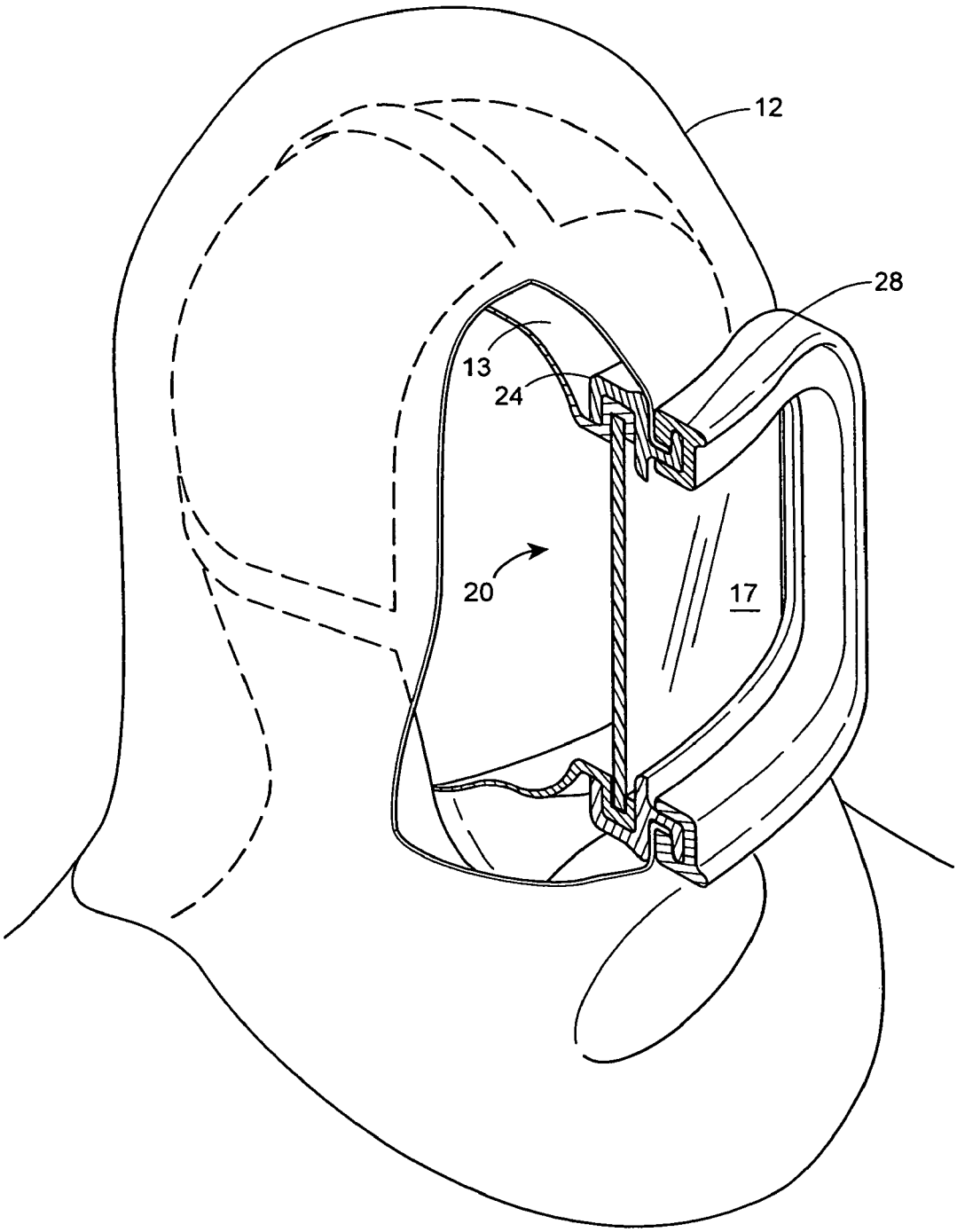
FIG. 2 is an isometric view of a hood portion of the hazard suit of FIG. 1 in which a gas mask is removably attached to hood material via a first embodiment of a protective seal.
Figure 3:
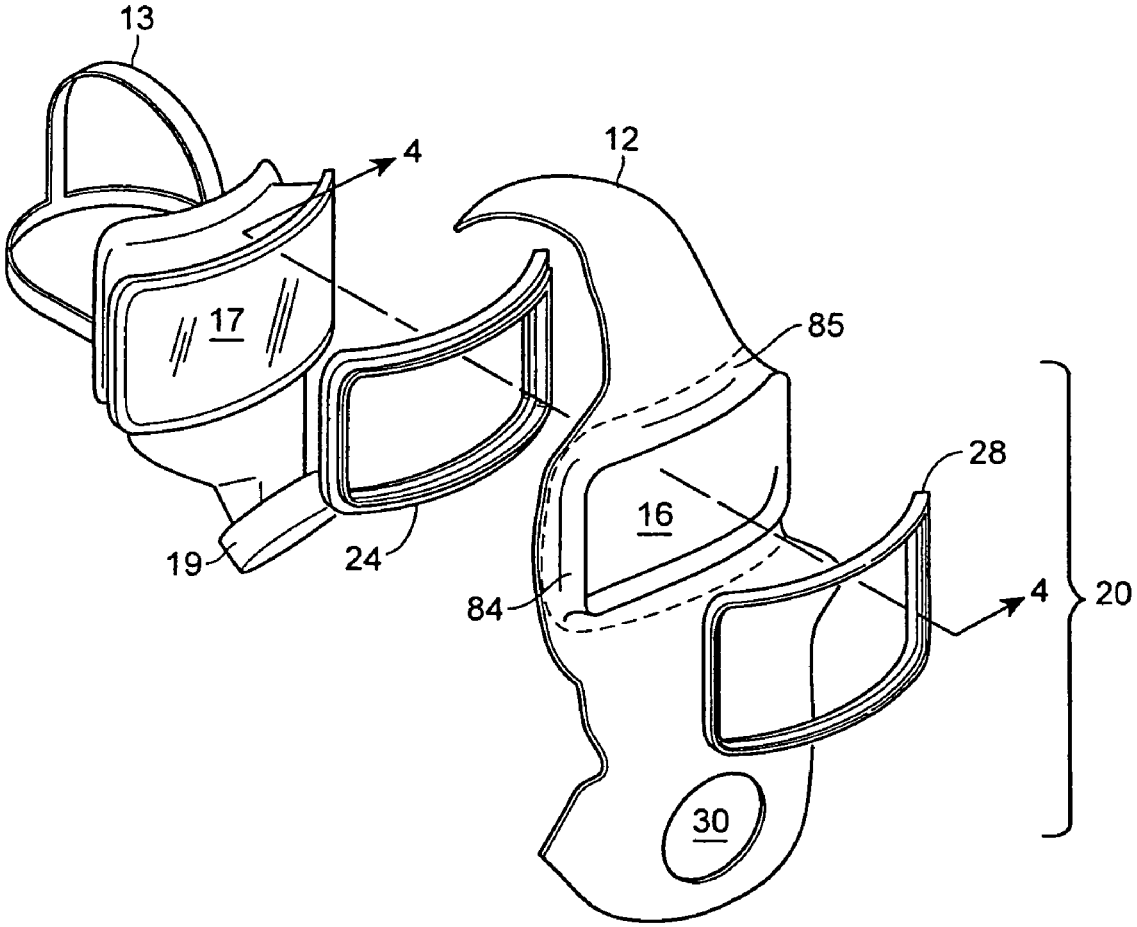
FIG. 3 is an exploded view of the gas mask, the hood and the protective seal of FIG. 2.

FIGS. 2 and 3 illustrate the interconnection of the hood 12 and the gas mask 13 in more detail to illustrate one manner in which a sealing mechanism 20 can be used to removably connect the gas mask 13 to the hood 12. Generally speaking, the gas mask 13 may be any desired type of mask commonly used to protect a user from airborne contaminants and may be, for example, a gas mask typically used in any of many environments including, but limited to, military, medical, and hazardous waste environments. As such, the term gas mask is used herein to include or refer to any type of mask used with any type of breathing apparatus, such as fire or contaminant protection masks, and is not intended to be limited to traditional gas masks having filters for filtering gas in the environment. While the gas mask 13 illustrated in FIGS. 2 and 3 includes the respirator 19 for filtering air delivered into the gas mask 13, the gas mask 13 may instead or in addition be connected to a separate source of air such as, for example, a compressed tank of air (not shown) via a hose or the like. If desired, the gas mask 13 may be constructed from a pliable or flexible rubber material for forming around the head and/or facial area of the user, and may include a window, such as a visor 17. As is typical, the visor 17 may have a generally rectangular shape that is outwardly curving and that is constructed from a generally thin and transparent material such as plastic, glass or any other clear or see-through material.

FIG. 2 illustrates the visor 17 of the gas mask 13 as being connected to the hood 12 of the hazard suit 10 by a combination of a framing ring 24 and a locking ring 28 which together form the sealing mechanism 20. As illustrated in FIG. 2, the framing ring 24 is connected to or around the visor 17 of the gas mask 13 while the locking ring 28 traps a portion of the hood 12 between one or more surfaces of the framing ring 24 and the locking ring 28 to thereby provide an airtight seal between the visor 17 of the gas mask 13 and the hood 12. As will be described in more detail below, the locking ring 28 preferably fits into the framing ring 24 using a snap-fit type connection that is easy to manipulate and that provides the wearer or user with a positive or tactile indication that the seal is complete.

FIG. 3 illustrates an exploded view of the combination of the gas mask 13, a cut-away portion of the hood 12 and the sealing mechanism 20. From FIG. 3, it can be seen that the framing ring 24 is generally disposed between the visor 17 of the gas mask 13 and an aperture 16 within the hood 12, while the locking ring 28 is generally disposed outside of the hood 12. More particularly, the locking ring 28 operates to trap edge material 22 of the hood 12 around the aperture 16 between the locking ring 28 and the framing ring 24 to produce the seal between the visor 17 and the hood 12. Because the aperture 16 of the hood 12 receives the gas mask 13 and, more specifically, the visor 17 for the gas mask 13, the aperture 16 has a generally rectangular shape that may correspond to the shape of the visor 17. Furthermore, to produce a better seal between the hood 12 and the visor 17, the hood 12 may include a rim 85 having an outwardly extending lip 84 disposed continuously around the aperture 16 with the lip 84 sized and shaped to fit into a channel formed in the framing ring 24 without substantially overlapping or folding onto itself. As will be seen from FIG. 3, the framing ring 24 and the locking ring 28 are substantially complementary in shape, so that the framing ring 24 and the locking ring 28 define essentially the same aperture and have portions that fit into one another around the entire edge or circumference of the aperture. While FIG. 3 illustrates the that rings 24 and 28 are generally rectangular in shape, these rings could take on any other general shape, such as oval, circular, triangular, etc. depending on the shape of the object being attached to the protective garment 10.

Figure 4:
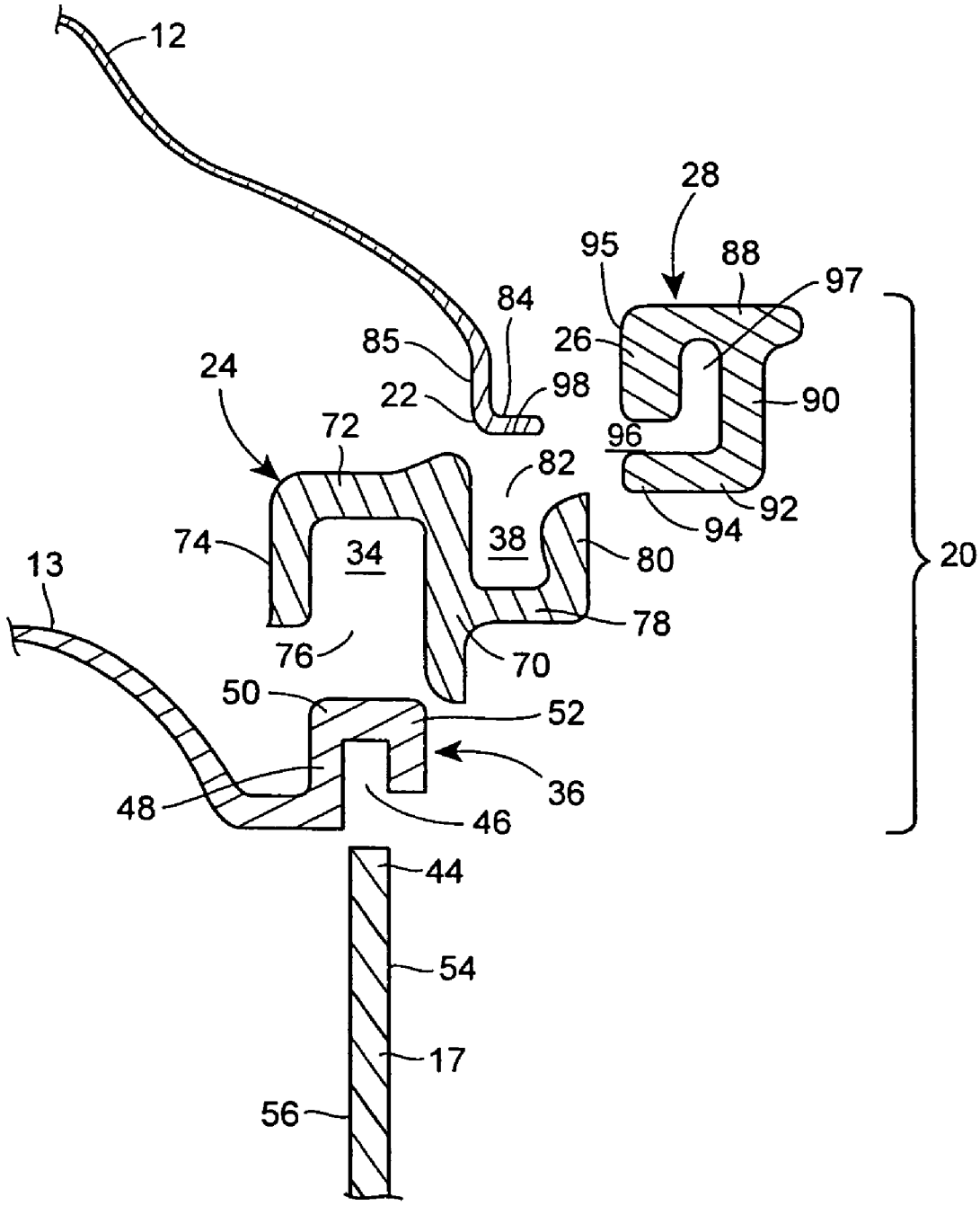
FIG. 4 is a disassembled cross-sectional view of the protective seal, a portion of the visor and a portion of the hood material generally taken along line 4-4 of FIG. 3.

FIG. 4 illustrates in more detail the various components used to create the seal between the gas mask 13 and the hood 12. In particular, as shown in FIG. 4, the visor 17 is held in the gas mask 13 by inserting an edge 44 of the visor 17 into a groove 46 integrally formed in the gas mask 13. In particular, the groove 46 is defined by an inner wall 48, an upper wall 50 and an outer wall 52, wherein the inner and outer walls 48 and 52 are oriented generally parallel to one another. As a result, at least portions of an outer surface 54 and an inner surface 56 of the visor 17 are in contact with and abut the inner wall 48 and the outer wall 52 of the groove 46, respectively. As can be seen in FIG. 4, the walls 48, 50 and 52 of the gas mask 13 define a ridge 36 that receives the framing ring 24 and define a groove 46 that receives the visor 17.

The framing ring 24 illustrated in FIG. 4 includes first and second channels 34 and 38 which form continuous channels around the aperture formed by the framing ring 24 and which are generally U-shaped in cross section. In particular, the framing ring 24 includes a vertically oriented center wall member 70, an upper wall member 72 that extends inwardly or towards the user from a top of the center wall member 70 and that is oriented generally perpendicular to the center wall member 70 and an inner wall member 74 that extends downwardly from the upper wall member 72. The inner wall member 74 in combination with the upper wall member 72 and the center wall member 70, defines the first channel 34, which includes a downwardly facing opening 76 for receiving the ridge 36 of the gas mask 13. Additionally, the framing member 24 includes a lower wall member 78 that extends outwardly or away from the user from a bottom of the center wall member 70 and that is oriented generally perpendicular to the center wall 70 and an outer wall member 80 that extends upwardly from the lower wall member 78. The outer wall member 80, in combination with the lower wall member 78 and the center wall member 70, defines the second channel 38 which includes an upwardly facing opening 82 for receiving a portion of the locking ring 28 as will be described in more detail later. As will be understood, the first channel 34 of the framing ring 24 is sized and shaped to engage the ridge 36 on the gas mask 13 in an airtight and possibly permanent manner, while the second channel 38 is sized and shaped to receive the edge material 22 of the aperture 16 and a locking wall member 26 of the locking ring 28 in a removable manner. It will be understood that, while the first channel 34 is illustrated as being disposed on the framing ring 24 and the ridge 36 is illustrated as being disposed on the visor 17 of the gas mask 13, the channel 34 or a similar channel could instead, be disposed on the visor 17 of the gas mask 13 and the ridge 36 or a similar ridge could be disposed on the framing ring 24 so that a ridge on the framing ring 24 engages a channel on the visor 17 in a sealable manner. Alternatively, any other suitable sealable connection structure could be used on the visor 17 and the framing ring 24 to enable these two elements to be permanently or removably connected to one another.

Figure 5:
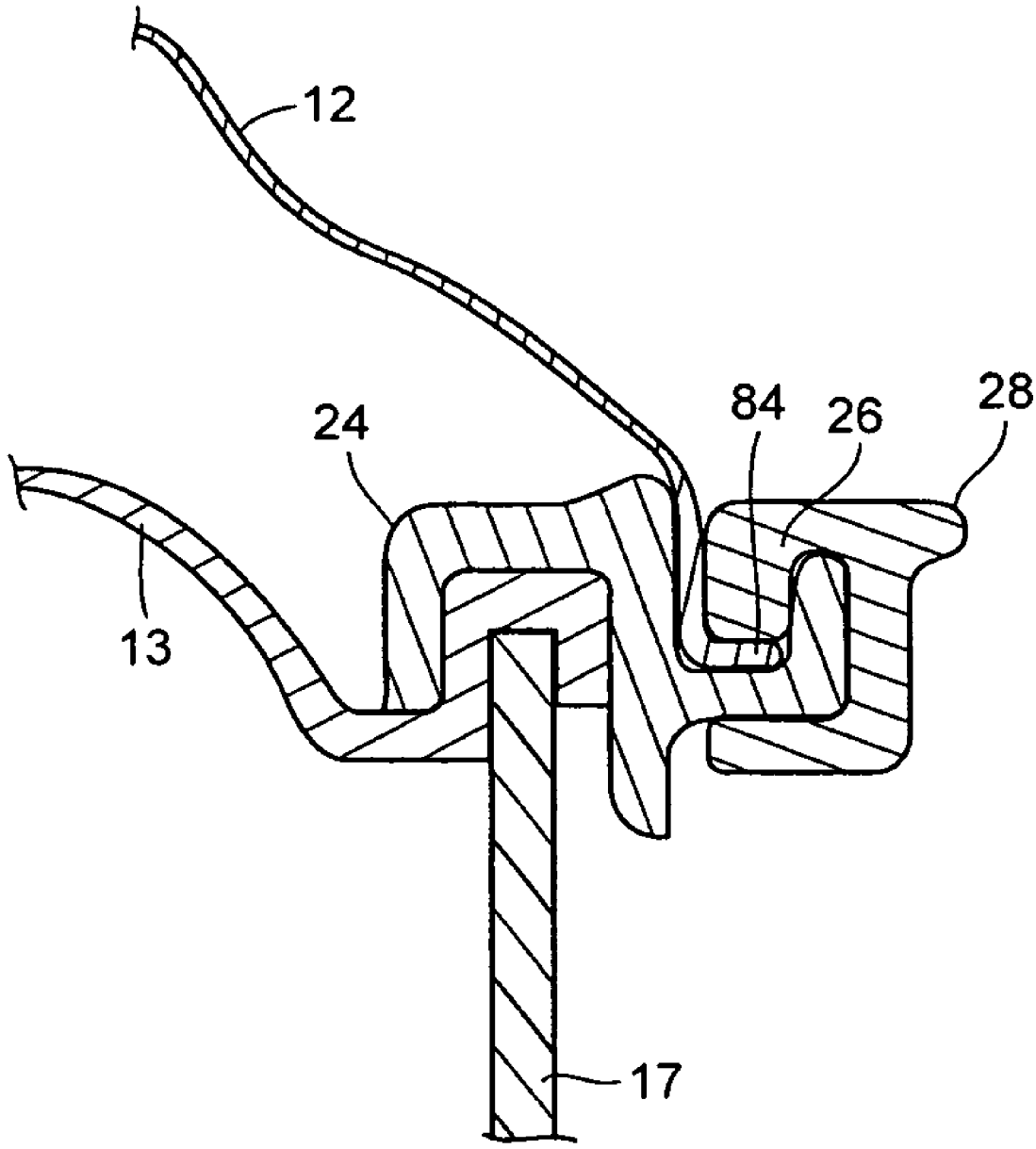
FIG. 5 is a detailed cross-sectional view of the protective seal of FIG. 2 when the protective seal operates to seal the visor of FIG. 2 to the hood of FIG. 2.

As also illustrated in FIG. 4, the locking ring 28 includes the locking wall member 26 that extends downwardly from an end of an upper wall member 88 and further includes an outer wall member 90 that extends vertically between a lower wall member 92 and the upper wall member 88. A first end 94 of the lower wall member 92 is located beneath or adjacent the locking wall member 26 and the locking wall member 26 is shorter in height (when viewed in cross section) than the outer wall member 90 so a gap or an opening 96 is formed between the locking wall member 26 and the lower wall member 92. Additionally, the lower wall member 92 extends generally to a plane shared by an outer surface 95 of the locking wall member 26. As illustrated in FIG. 4, a space or locking channel 97 is formed by the wall members 26, 90, 92 and 88 and this locking channel 97 is generally sized to accept the wall member 80 of the framing ring 24 in a snug or tight but removable manner. As will be seen in FIG. 4, the locking channel 97 which forms a continuous channel or path around the aperture defined by the locking ring 28 is generally L-shaped in cross section. Additionally, the gap or opening 96 is sized to accept the wall member 78 and the lip 84 of the edge material 22 in a tight or snug manner and, in fact, the gap 96 may be slightly more narrow than the wall member 78 or than the combination of the wall member 78 and the lip 84 to cause the locking ring 28 to provide a positive force to the lip 84 and the wall member 78 when the locking ring 28 engages the framing ring 24, as illustrated in FIG. 5. Additionally, the locking ring 28 and, more specifically, the locking wall member 26 of the locking ring 28 is sized and shaped to engage the second channel 38 of the framing ring 24 in a tight or snap-fit manner with the rim material 85 disposed therein. If desired, the locking wall member 26 may be the same thickness as or slightly thicker than the width of channel 38 (as defined by the distance between the wall members 70 and 80) to cause the wall members 70, 78 and 80 forming the channel 38 to provide a positive force to the rim 85 and the locking wall member 26 when the locking ring 28 engages the framing ring 24, as illustrated in FIG. 5, to thereby provide a better or more complete seal. In some cases, however, depending on the thickness of the material at the rim 85, the locking wall member 26 may be somewhat less than the width of the channel 38, with the material at the rim 85 filling in the extra space to cause the locking wall member 26 to interact with the channel 38 to provide a positive sealing force on the material of the hood 12. Of course, in any event, the locking wall member 26 has a thickness that is small enough to allow the locking wall member 26 to be inserted into the channel 38 along with the portion of the garment edge disposed in the channel 38, and large enough to provide positive pressure against the portion of the garment edge and the two wall members 70 and 80 when the locking wall member 26 is inserted into the channel 38. Of course, the wall member 80 of the framing ring 24 interacts with the locking channel 97 in a similar manner, although the material from the hood 12 need not be (but can be) disposed between these elements during the sealing process.

As will be understood, to form a seal using the framing ring 24 and the locking ring 28, the edge material 22 and, in particular, the lip 84 of the edge material 22 disposed around the aperture 16 of the hood 12 is placed in the second channel 38 of the framing ring 24 such that a bottom surface 98 of the lip 84 is oriented generally parallel to the lower wall member 78 of the locking ring 28, and such that at least a portion of the rim 85 is oriented generally parallel to and abutting the central wall member 70 of the locking ring 28. In this exemplary embodiment, the lip 84 may be shaped and sized to fit within the second channel 38 without having to bend, deform or fold onto itself, so that a majority of the bottom surface 98 of the lip 84 contacts the lower wall member 78. The preshaping of the lip 84 to fit within the channel 38 provides a better seal when the locking ring 28 is disposed to engage the framing ring 24 because this preshaping reduces or prevents folds or gaps forming in the sealing area. In some cases, if desired, the lip 84 may be long enough to wind its way around the wall member 80 of the framing ring 24 and may stick out of or beyond the framing ring 24 and the locking ring 28 when these rings are engaging one another. In this case, however, it is considered that a portion of the lip or a portion of the edge of the garment 10 is still disposed within the channel 38 and the locking channel 97.

In any event, the material of the lip 84 is secured in the channel 38 by engaging or snapping the locking wall member 26 of the locking ring 28 into the second channel 38 of the framing ring 28. This seal is formed all the way around the framing and locking rings 24 and 28 which form continuous channels around the aperture defined by the lip 84 to thereby cause a continuous seal between the edge of the visor 17 of the gas mask 13 and the hood 12. As will be understood and as best illustrated in FIG. 5, during use the locking ring 28 operatively connects, clips or snaps onto the framing ring 24 and in doing so secures the lip 84 between the locking ring 28 and the framing ring 24. More specifically, the locking ring 28 secures the lip 84 by engaging the locking wall member 26 of the locking ring 28 with the second channel 38, in which the lip 84 is disposed. Thus, as will be understood, the seal mechanism 20 operates as a simple snapping mechanism that connects the visor 17 of the gas mask 13 to the hood 12 using the framing ring 24 and the locking ring 28, to thereby create an airtight seal between the gas mask 13 and the hood 12.

In order to enhance the sealing action, the material forming lip 84 may be thicker then the material forming the rim 85 and/or the majority of the sheet of material of which the hood 12 is constructed. Still further, the lip 84 may be oriented generally perpendicular relative to the rim 85 and/or may be oriented generally parallel to the lower wall 78 of the framing ring 24. Both of these features, while not necessary, tend to provide a better or stronger seal when the lip 84 is disposed between the framing ring 24 and the locking ring 28 and may help prevent the lip 84 from tearing or splitting during use repeated use.

While the framing ring 24 and the locking ring 28 are illustrated in FIG. 3 as being constructed from a single integrally formed piece of material, either or both of the framing ring 24 and the locking ring 28 may instead be constructed from more than one piece of material. Furthermore, the framing ring 24 and the locking ring 28 may be constructed from any suitable material, but are preferably constructed from a rigid or a semi-rigid material such as stiff or pliable rubber.

The above exemplary embodiment may be varied, to achieve and/or create additional or alternative features. For example, the framing ring 24 need not be separate from the gas mask 13 or the ridge 36, but may be, for example, an integral part or integrally formed with the gas mask 13 or the ridge 36. Similarly, the edge 22 need not include the lip 84 and/or may include a lip 84 that has a shape or structure other than described herein. For example, the lip 84 may be L-shaped, U-shaped or any other shape in cross section, and may be formed to fit around a circular, an oval or any other shaped object. Additionally, the lip 84 may be separate from the hood 12, the rim 85 or the protective garment 10, and may be constructed from a material that is the same as or that is different than the remainder of the protective garment 10. Still further, the framing ring 24 may simply include a wall (instead of a channel made up of two or more walls) that engages a channel within the locking ring 23 with the material of the protective garment disposed between these two members.

Because of the construction of the sealing mechanism 20, a user may don or wear the gas mask 13 prior to donning the hazard suit 10 and thus, may put on the hazard suit without needing to remove the gas mask 13, which may be beneficial in many instances. In this case, the user may first attach the framing ring 24 to the outer edge of the gas mask 13 by placing the first channel 34 of the framing ring 24 onto the ridge 36 of the gas mask 13. Of course, currently available gas masks may already include the ridge 36, such that the sealing mechanism 20 can be used with the gas mask without alteration of the gas mask. Alternatively, the gas mask 13 may be retrofitted with the ridge 36 or a ridge-like structure for use with the sealing mechanism 20. In any event, with the ridge 36 disposed on the gas mask 13, the user may engage or snap the framing ring 24 on the ridge 36 and, more specifically, may engage the first channel 34 of the framing ring 24 with the ridge 36 on the gas mask 13, as generally illustrated in FIGS. 2 and 4. In this exemplary embodiment, the first channel 34 and the ridge 36 may be engaged such that the walls 70, 72, 74 of the first channel 34 abut the respective walls 52, 50, 48 of the ridge 36, or until the framing ring 24 is fully engaged and seated on the gas mask 13. Of course, if desired, the gas mask 13 may be constructed to include the framing ring 24 permanently or integrally attached thereto, in which case, the first channel 34 on the framing ring 28 is not necessary.

Like the ridge 36, the inverted U-shaped portion of the framing ring 24 which includes the first channel 34 defined by the center wall member 70, the upper wall member 72, and the inner wall member 74 may already exist on current gas masks. As such, the gas mask 13 may be retrofitted to be used with the sealing mechanism 20, by removing some of the already existing hardware such as the inverted U-shaped portion, and replacing it with the framing ring 24 as previously described.

With the first channel 34 of the framing ring 24 engaged with the gas mask 13, the second channel 38 will be facing upwardly away from the visor 17, ready to receive the sheet of material from which the hood 12 is constructed and the locking ring 28. As a result, in this example, the user may put on the hazard suit 10 while wearing the gas mask 13, and in doing so may align the orifice 16 with the visor 17 of the gas mask 13. The user may then press, insert, or lay the edge 22 of the aperture 16 and, more specifically, may place the lip 84 toward the bottom of the second channel 38 of the framing ring 24 attached to the gas mask 13. The lip 84 may be placed in the second channel 38 so that the bottom surface 98 of the lip 84 abuts the lower wall 78 of the locking ring 28 and so that at least a portion of the rim 85 abuts the central wall 70 of the locking ring 28. In this exemplary embodiment, the lip 84 is be shaped and sized to fit within the second channel 38 without having to bend or deform the lip 84, such that a majority of the bottom surface 98 of the lip 84 contacts the lower wall 78. Additionally and/or alternatively, the lip 84 may be shaped and sized such that, upon compression of the lip 84 by the locking wall member 26 of the locking ring 28, the lip 84 has sufficient room to expand without compromising the seal between the framing ring 24 and the locking ring 28.

The edge 22 and, more specifically, the lip 84 of the hood 12 may then be secured in the second channel 38 by engaging or snapping the locking wall member 26 of the locking ring 28 into the second channel 38. More specifically, the user may guide the opening 96 of the locking ring 28 toward a top of the outer wall member 80 of the framing ring 24, such that the locking wall member 26 of the locking ring 28 engages the second channel 38, and such that the lower wall member 92 of the locking ring 28 slidingly engages the outer wall member 80 of the framing ring 24. As the locking ring 28 is further pressed or snapped onto the framing ring 24, the locking wall member 26 abuts the rim 85 and the outer wall member 80, thereby securing the locking wall member 26 and the lip 84 in the second channel 38. Additionally, as the locking ring 28 is further pressed or snapped into the framing ring 24, the lower wall member 92 overcomes a corner created by the connection of the lower and outer wall members 78 and 80 of the framing ring 24, resulting in the lower wall member 92 of the locking ring 28 abutting and being oriented generally parallel to the lower wall member 78 of the framing ring 24. As a result, the engagement of the locking ring 28 with the framing ring 24 prevents the locking ring 28 from becoming dislodged from the framing ring 24 unintentionally, while securing the hood 12 to the gas mask 13. Still further, because of the snap-fit connection and the tactile sensation resulting from the placement of the locking ring 28 into the framing ring 24, the user can easily determine that the proper seal has been attained between the locking ring 28 and the framing ring 24.

Of course, if desired, the user may alternatively don the gas mask 13 at the same time as the hazard suit 10, by pre-attaching the gas mask 13 to the hood 12 of the hazard suit 10. As will also be understood, the user may remove the hazard suit 10 without removing the gas mask 13 by simply pulling the locking ring 28 out of connection with the framing ring 24 and then removing the hazard suit 10.

While, for sake of brevity and clarity, the seal or seal mechanism 20 is described herein as being used to connect the gas mask 13 to the hood 12 of the hazard suit 10, the seal mechanism 20 is not limited to this use. Instead, a similar seal mechanism may be used to connect other elements to the hazard suit 10, including, for example, to connect a respirator filter 19 of the gas mask 13 to an aperture 30 within the hood 12, to connect the hose 18 shown in FIG. 1 to the hazard suit 10, to connect the respirator 21 shown in FIG. 1 to the hazard suit 10, etc. In these cases, of course, the framing and locking rings used with the seal will be sized and shaped to fit the particular object or element being attached to the suit and thus, may be circular, oval, rectangular or any other desired shape. Furthermore, while illustrated and described as a hazard suit, the protective garment 10 may be any of many different types of covers or devices while the objects that can be connected to the garment 10 via the seal or seal mechanism 20 may be any of many different types of objects. For example, the protective garment 10 may be any other type of covering or material, such a tent, a blanket, a vehicle cover, etc. and the seal mechanism 20 may be used to enable any other types of objects or structure, such as windows, tools, etc. to be removably attached to a protective garment 10. Of course, the seal mechanism 20 is not limited to the uses identified above or elsewhere herein, but may adapted for any number of other uses.

Figure 6:
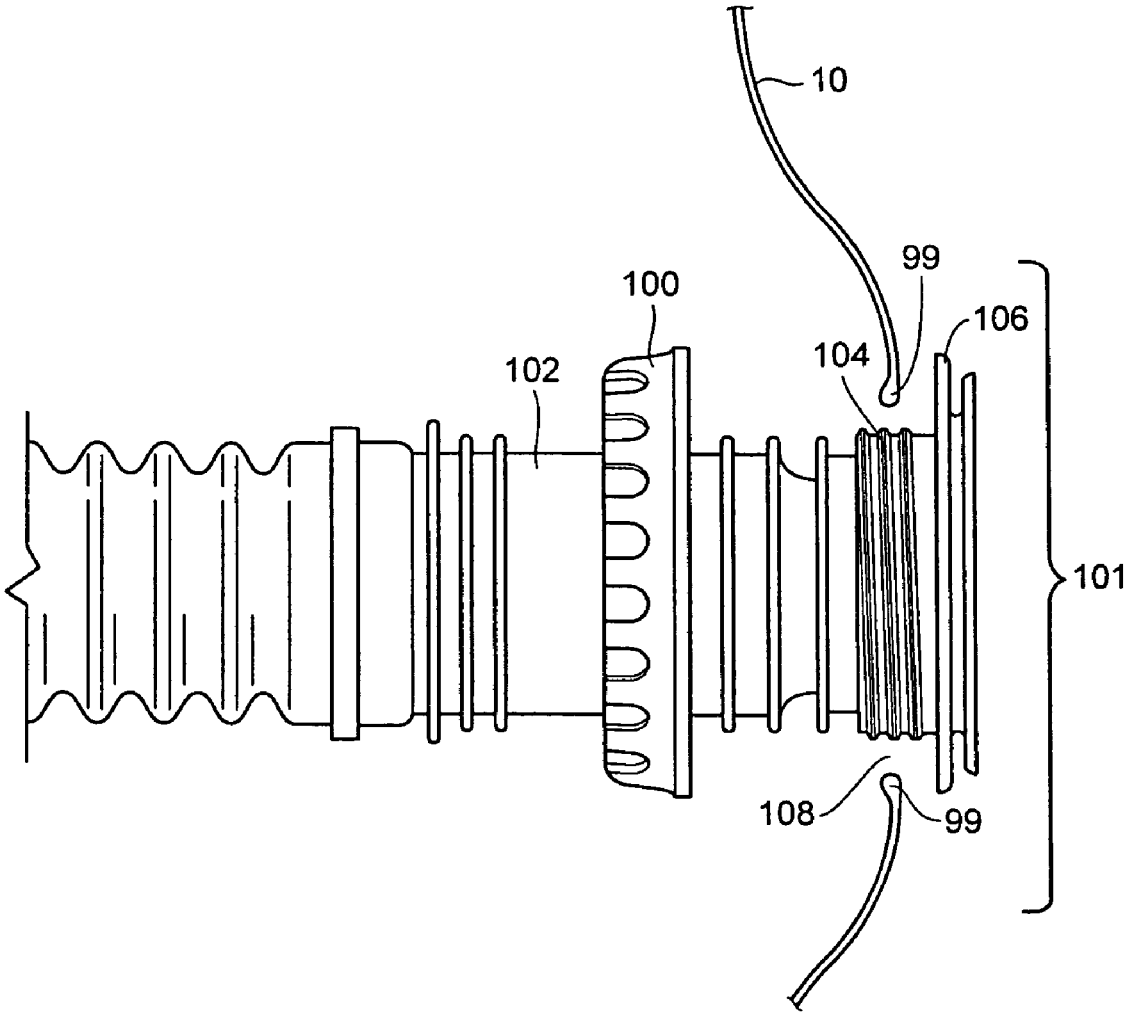
FIG. 6 is a cross-sectional view taken along line 6-6 of FIG. 1 illustrating a second embodiment of a sealing mechanism used on the hazard suit of FIG. 1 to connect a circular hose member to the hazard suit of FIG. 1.

As an example, in another exemplary embodiment illustrated in FIG. 6, a molded polymer edge 99, similar to the edge 22, may be utilized in conjunction with other sealing mechanisms to form a seal between the protective garment 10 and a tube or hose 102. In this case, a sealing mechanism 101 may include a compression nut 100 that engages an externally threaded surface 104 on the connecting tube 102 at one end and that engages a flange 106 at the other end. The connecting tube 102 may then be placed into an aperture 108 in the protective garment 10, such that the flange 106 of the tube 102 is disposed on the interior of the garment 10 while the compression nut 100 is disposed on the exterior of the garment 10. The compression nut 100 may then be rotated on the externally threaded surface 104 toward the flange 106, eventually compressing an edge or lip 99 of the garment 10 between the flange 106 and the compression nut 100, thereby, creating a seal between the garment 10 and the tube 102. As illustrated in FIG. 6, the edge or lip 99 of the garment 10 may be thicker than the rest of the garment material and/or may include or comprise a lip defining the aperture 108 to provide a better seal when the compression nut 100 forces the garment material against the flange 106 and/or to prevent tearing or ripping of the garment material at this location as a result of repeated connection and disconnection of the hose or tube 102 to the garment 10.

While the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention

What is claimed is:

1. A sealing mechanism for sealing a protective garment to an object, the sealing mechanism comprising:

a framing ring having a center wall member, an inner wall member disposed substantially parallel to the center wall member, and an outer wall member disposed substantially parallel to the center wall member and disposed opposite the center wall member from the inner wall member;

a first channel defined between the center wall member and the inner wall member of the framing ring and a second channel defined between the center wall member and the outer wall member of the framing ring, wherein the first channel is adapted to sealingly engage the object, the first and second channels having U-shaped cross-sections such that the first channel has a first opening that opens in a first direction and the second channel has a second opening that opens in a second direction that is opposite the first direction; and a locking ring having a locking wall member and a locking channel, wherein the locking wall member is disposed in the second channel of the framing ring and the locking channel receives the outer wall member of the framing ring to secure a portion of the protective garment in the second channel of the framing ring, wherein the locking ring further includes first, second, and third wall members and wherein the locking wall member and the first, second, and third wall members are connected together to form the locking channel, wherein the first wall member is connected to and is disposed generally perpendicularly to the second wall member, the second wall member is connected to and is disposed generally perpendicularly to the third wall member, and the third wall member is connected to and is disposed generally perpendicularly to the locking wall member, and wherein a height of the locking wall member when viewed in cross section is shorter than a height of the second wall member when viewed in cross section to form a gap between the locking wall member and the first wall member, the gap forming an entrance to the locking channel.

2. The sealing mechanism of claim 1, wherein the framing ring and the locking ring have complementary shapes.

3. The sealing mechanism of claim 2, wherein the framing ring and the locking ring are rectangular shaped.

4. The sealing mechanism of claim 2, wherein the framing ring and the locking ring are circularly shaped.

5. The sealing mechanism of claim 1, wherein the first channel of the framing ring comprises a continuous channel forming an aperture.

6. The sealing mechanism of claim 1, wherein the locking channel in the locking ring forms a continuous path around an aperture.

7. The sealing mechanism of claim 6, wherein the locking wall member forms one side of the locking channel.

8. The sealing mechanism of claim 1, wherein the locking channel is generally L-shaped in cross section.

9. The sealing mechanism of claim 1, wherein the locking channel is generally L-shaped in cross section.

10. The sealing mechanism of claim 1, wherein the center wall member and the outer wall member of the framing ring are spaced apart by a first distance and wherein the locking wall member of the locking ring includes a thickness that is approximately equal to the first distance.

11. The sealing mechanism of claim 1, wherein the center wall member and the outer wall member of the framing ring are spaced apart by a first distance and wherein the locking wall member of the locking ring includes a thickness that is less than the first distance.

12. The sealing mechanism of claim 1, wherein the center wall member and the outer wall member of the framing ring are spaced apart by a first distance and wherein the locking wall member of the locking ring has a thickness that is small enough to allow the locking wall member to be inserted into the second channel with the portion of the protective garment disposed in the second channel, and large enough to provide positive pressure against the portion of the protective garment and the center and outer wall members when the locking wall member is inserted into the second channel.

13. The sealing mechanism of claim 1, wherein the locking ring includes a gap forming an entrance to the locking channel, the gap having a third opening that opens in a third direction that is substantially perpendicular to the first direction of the first opening of the first channel of the framing and substantially perpendicular to the second direction of the second opening of the second channel of the framing ring.

* * * * *